US010890873B2

(12) United States Patent
Hori

(10) Patent No.: US 10,890,873 B2
(45) Date of Patent: Jan. 12, 2021

(54) PROCESS UNIT AND IMAGE FORMING APPARATUS

(71) Applicant: SHARP KABUSHIKI KAISHA, Sakai (JP)

(72) Inventor: Takashi Hori, Sakai (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 16/383,308

(22) Filed: Apr. 12, 2019

(65) Prior Publication Data

US 2019/0317445 A1 Oct. 17, 2019

(30) Foreign Application Priority Data

Apr. 17, 2018 (JP) ..... 2018-079289

(51) Int. Cl.
*G03G 21/00* (2006.01)
*G03G 21/16* (2006.01)

(52) U.S. Cl.
CPC ..... *G03G 21/0029* (2013.01); *G03G 21/1619* (2013.01)

(58) Field of Classification Search
None
See application file for complete search history.

(56) References Cited

U.S. PATENT DOCUMENTS 5,828,929 A * 10/1998 Watanabe ..... G03G 21/1867 399/111
2018/0039225 A1* 2/2018 Miyamoto ..... G03G 21/08

FOREIGN PATENT DOCUMENTS

JP 2011-253119 A 12/2011

* cited by examiner

*Primary Examiner* — Victor Verbitsky
(74) *Attorney, Agent, or Firm* — ScienBiziP, P.C.

(57) ABSTRACT

A process unit includes a photosensitive drum on which an electrostatic latent image is to be formed, a charger that charges an outer circumferential surface of the photosensitive drum to a predetermined polarity and a predetermined potential, a cleaner that removes residual toner from the outer circumferential surface of the photosensitive drum, a process frame that holds the photosensitive drum and is provided with the cleaner, and a charger cover that holds the charger and is rotatably supported on the process frame so as to move the charger away from or closer to the photosensitive drum.

6 Claims, 11 Drawing Sheets

PROCESS UNIT AND IMAGE FORMING APPARATUS

BACKGROUND

1. Field

The present disclosure relates to process units of electrophotographic image forming apparatuses and, in particular, to a process unit including a photosensitive drum, a charger, and a cleaner and an image forming apparatus including such a process unit.

2. Description of the Related Art

An electrophotographic image forming apparatus has many functional components disposed around a photosensitive drum and forms an image through the action of each functional component. Examples of the functional components include a charger, an exposer, a developer, a transferer, a cleaner, a static eliminator, and the like.

In consideration of ease of maintenance and the like, an image forming apparatus is configured such that the photosensitive drum and each functional component are unitized alone or in combination so as to be easily attachable to and detachable from an image forming apparatus body.

Japanese Unexamined Patent Application Publication No. 2011-253119 discloses an image forming apparatus including a photosensitive unit and a charging unit. The image forming apparatus disclosed in Japanese Unexamined Patent Application Publication No. 2011-253119 is configured such that the charging unit is supported by a pressing lever and a rotational movement of the pressing lever allows the charging unit to displaced in a direction normal to a surface of a photosensitive drum of the photosensitive unit, so that maintenance of the charging unit can be carried out.

However, the technology disclosed in Japanese Unexamined Patent Application Publication No. 2011-253119 makes it necessary to separately provide a pressing lever that supports and displaces the charging unit, thus making the image forming apparatus complex in structure.

Further, there has been known a process unit in which a photosensitive drum, a charger, and a cleaner have been attached to a process frame. This process unit makes it necessary to remove the charger from the process frame in carrying out maintenance of the charger, as the charger is attached to the process frame. Further, this process unit also makes it necessary to remove the charger from the process frame first in carrying out maintenance of the photosensitive drum and the cleaner. Therefore, maintenance of the process unit has required many steps.

It is desirable to provide a process unit including a photosensitive drum, a charger, and a cleaner that makes it possible to easily carry out maintenance of the photosensitive drum, the charger, and the cleaner.

SUMMARY

According to an aspect of the disclosure, there is provided a process unit including a photosensitive drum on which an electrostatic latent image is to be formed, a charger that charges an outer circumferential surface of the photosensitive drum to a predetermined polarity and a predetermined potential, a cleaner that removes residual toner from the outer circumferential surface of the photosensitive drum, a process frame that holds the photosensitive drum and is provided with the cleaner, and a charger cover that holds the charger and is rotatably supported on the process frame so as to move the charger away from or closer to the photosensitive drum.

According to an aspect of the disclosure, there is provided an image forming apparatus including a process unit configured as described above.

DESCRIPTION OF THE EMBODIMENTS

Embodiment 1

Figure 1:
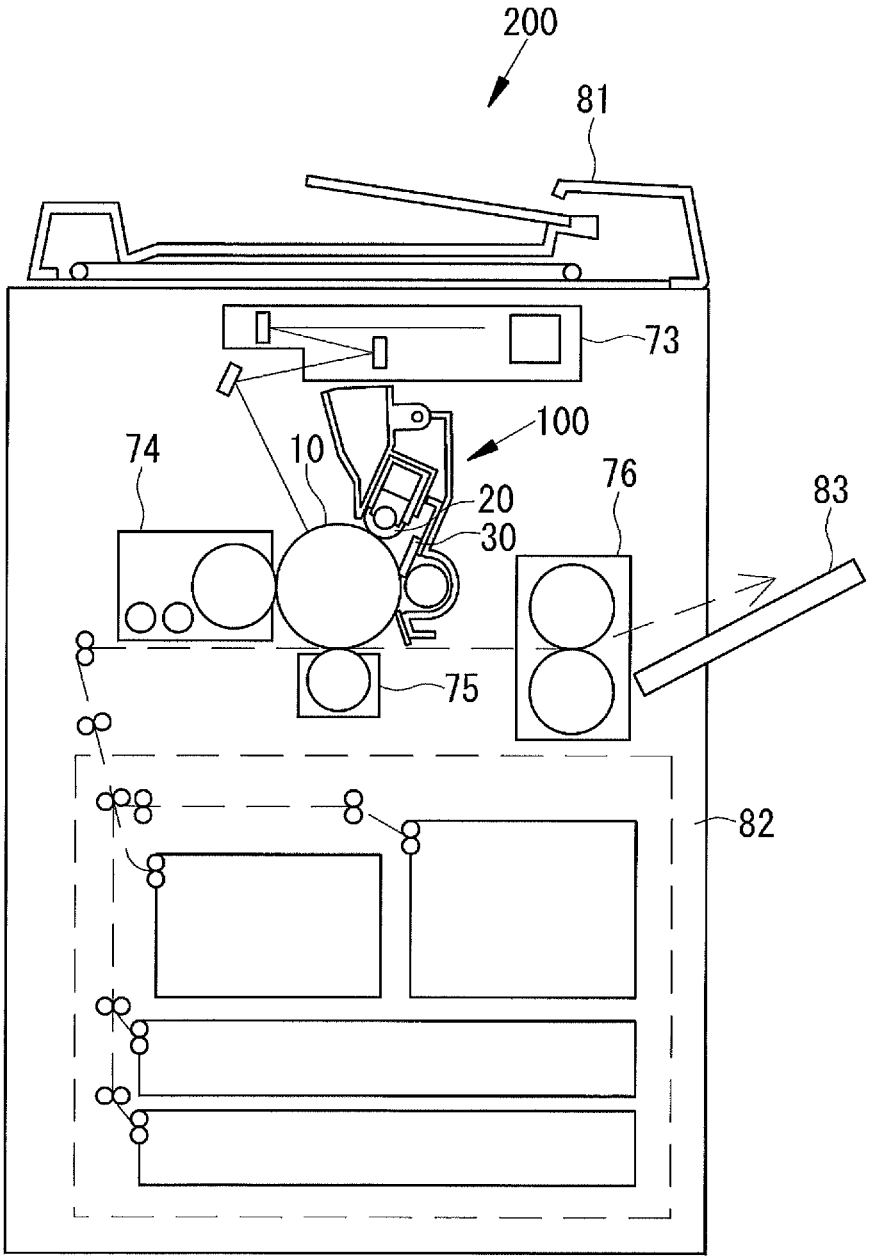
FIG. 1 is a longitudinal sectional view schematically showing an overall configuration of an image forming apparatus to which a process unit according to Embodiment 1 has been applied.

Embodiments of the present disclosure are described below with reference to the drawings. FIG. 1 is a longitudinal sectional view schematically showing an overall configuration of an image forming apparatus 200 to which a process unit 100 according to Embodiment 1 has been applied. The image forming apparatus 200 shown in FIG. 1 is a digital multifunction peripheral that can do printing of a document that is read by a scanner 81 or printing of image data that is inputted from an external device via a network.

The image forming apparatus 200 includes a photosensitive drum 10, a charger 20, a cleaner 30, an exposer 73, a developer 74, a transferer 75, a fixer 76, the scanner 81, a paper feed tray 82, and a paper output tray 83. The process unit 100 includes the photosensitive drum 10, the charger 20, and the cleaner 30.

The scanner 81 includes a document set tray, an automatic document feeder, a document reader, and the like. The document reader is provided with a document platen and a document scanner.

The paper feed tray 82 is a tray that accommodates recording paper such as plain paper, coated paper, color copy paper, and an OHP film. A plurality of the paper feed trays 82 are provided so that, for example, different sizes of paper are stored in each separate paper feed tray 82. Recording paper having an image formed thereon is ejected onto the paper output tray 83.

Figure 2:
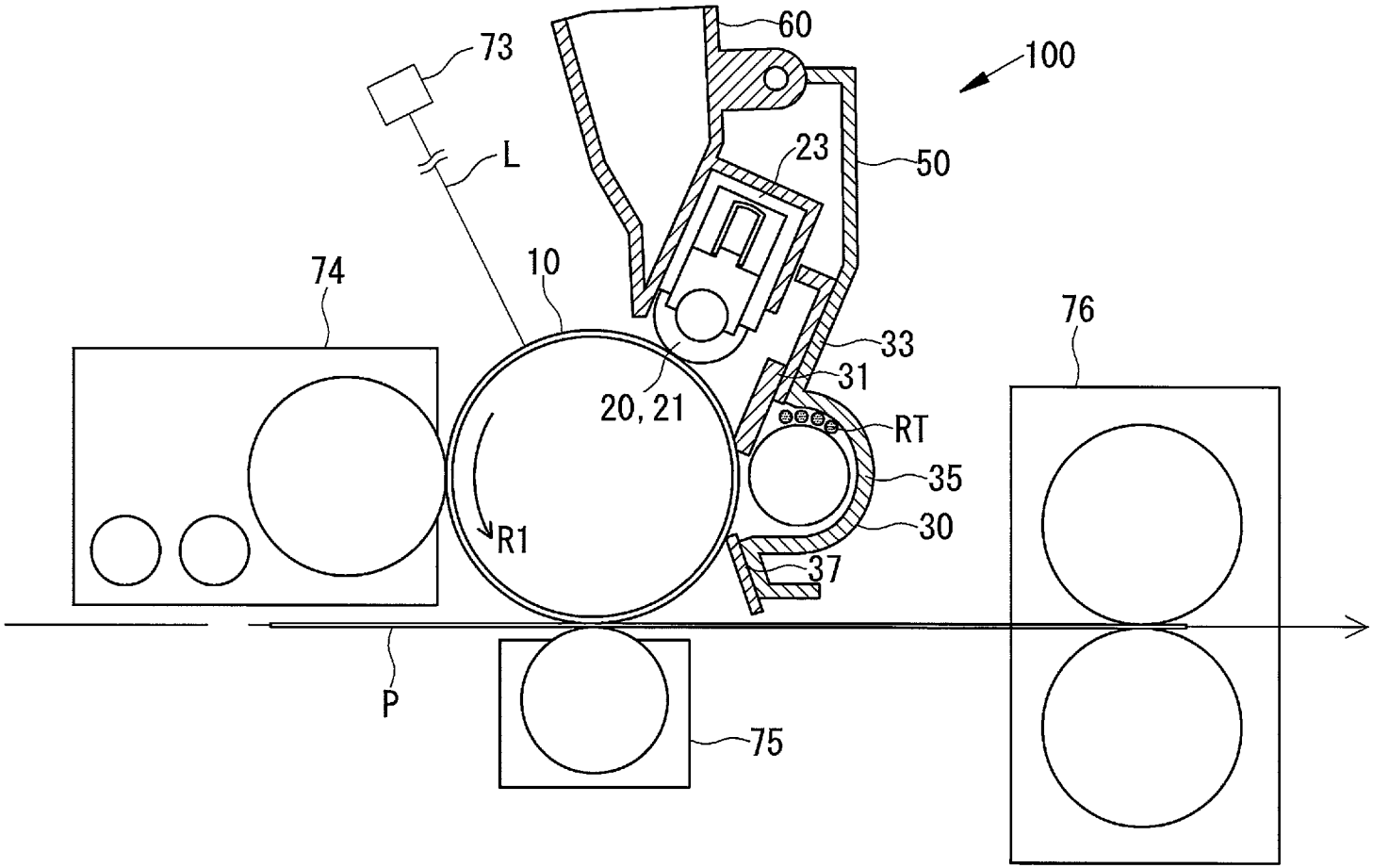
FIG. 2 is a diagram schematically showing a configuration of a photosensitive drum and components therearound in the image forming apparatus.

FIG. 2 is a diagram schematically showing a configuration of the photosensitive drum 10 and components therearound in the image forming apparatus 200 (see FIG. 1). As shown in FIG. 2, the charger 20, the cleaner 30, the exposer 73, the developer 74, the transferer 75, and the fixer 76 are provided around the photosensitive drum 10. The process unit 100 includes the photosensitive drum 10, the charger 20, the cleaner 30, a process frame 50, and a charger cover 60.

The photosensitive drum 10 is a roller-shaped member provided so as to be able to be driven to rotate in the direction of an arrow R1. The photosensitive drum 10 has a photosensitive film, formed on a surface thereof, on which an electrostatic latent image and a toner image are to be formed.

The charger 20 charges an outer circumferential surface of the photosensitive drum 10 to a predetermined polarity and a predetermined potential. In Embodiment 1, the charger 20 is a charging roller 21 and constitutes a charging unit 23. The charging roller 21 charges the photosensitive drum 10 by making contact with the outer circumferential surface of the photosensitive drum 10. The charging unit 23 is detachably attached to the charger cover 60.

The cleaner 30 removes residual toner from the outer circumferential surface of the photosensitive drum 10. The cleaner 30 includes a cleaning blade 31, a cleaning blade attacher 33, a waste toner receiver 35, and a toner-receiving sheet 37.

The cleaning blade 31 is a plate-shaped member that makes contact with the outer circumferential surface of the photosensitive drum 10 and scrapes the residual toner, paper powder, and the like away from the outer circumferential surface of the photosensitive drum 10. The cleaning blade attacher 33 is a member, formed as part of the process frame 50, to which the cleaning blade 31 is detachably fitted. The waste toner receiver 35, formed as part of the process frame 50, accommodates residual toner scraped away by the cleaning blade 31. The toner-receiving sheet 37 seals a space between the waste toner receiver 35 and the photosensitive drum 10.

While the photosensitive drum 10 is in a charged state, the exposer 73 (see FIG. 1) irradiates the photosensitive drum 10 with signal light L corresponding to image data. The signal light L, with which the outer circumferential surface of the photosensitive drum 10 has been irradiated, forms an electrostatic latent image corresponding to the image data.

The developer 74 supplies toner to the outer circumferential surface of the photosensitive drum 10 and renders the electrostatic latent image formed on the outer circumferential surface of the photosensitive drum 10 visible as a toner image.

The transferer 75 applies a transfer bias to the back side of recording paper P passing through a space between the photosensitive drum 10 and the transferer 75 and transfers, onto the recording paper P, the toner image rendered visible on the outer circumferential surface of the photosensitive drum 10.

The fixer 76 heats and presses the recording paper P as the recording paper P passes through a fixing nip, thereby fusing and fixing the toner image transferred onto the recording paper P.

Figure 3:
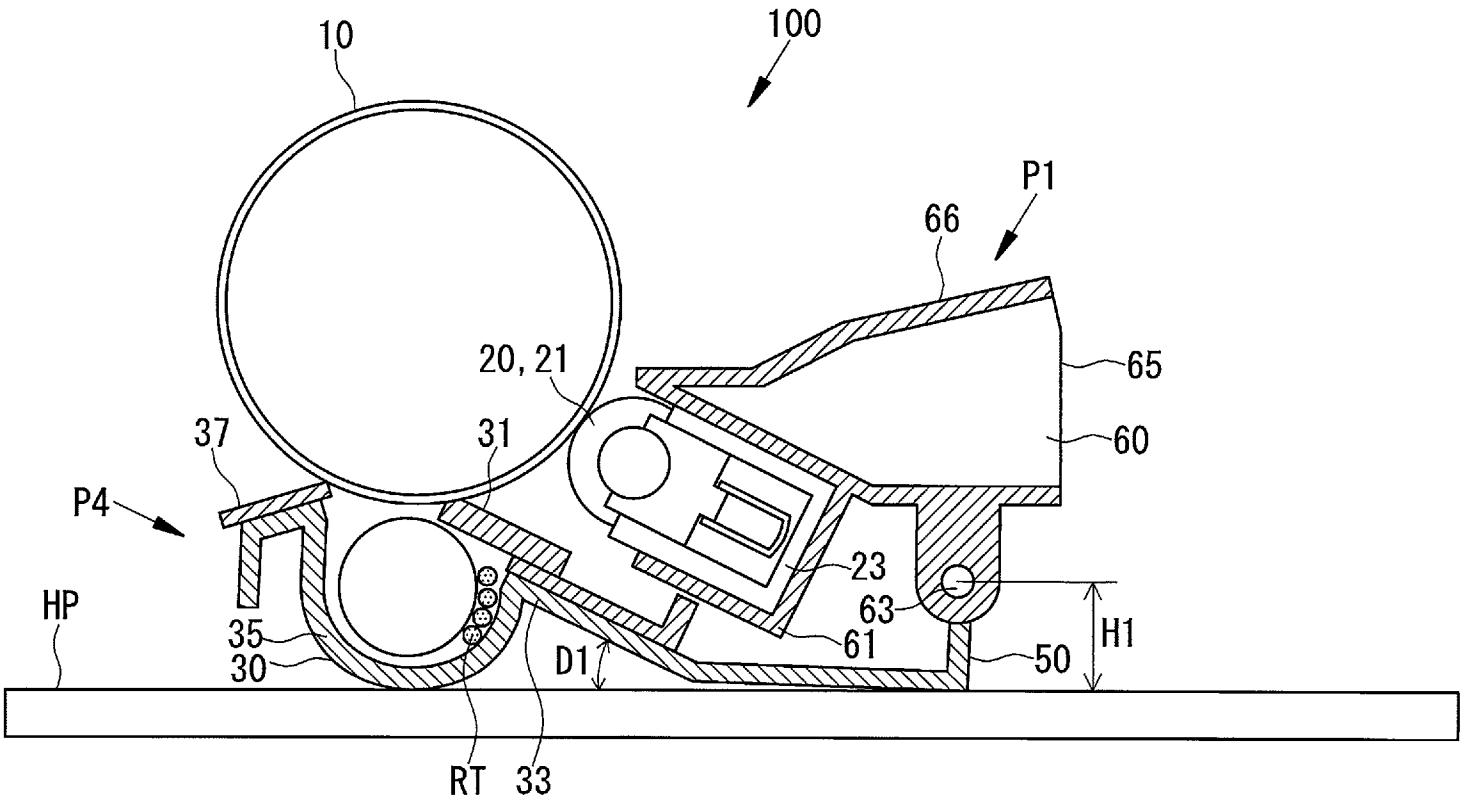
FIG. 3 is a cross-sectional view schematically showing a state where a process unit according to Embodiment 1 has been placed on a horizontal plane.

FIGS. 3 to 8 are each a cross-sectional view schematically showing a state where a process unit 100 according to Embodiment 1 has been placed on a horizontal plane HP. As shown in FIG. 3, the process unit 100 includes a photosensitive drum 10, a charger 20, a cleaner 30, a process frame 50, and a charger cover 60. FIG. 3 shows a state where the process unit 100 has been placed on the horizontal plane HP so as to be in such a position that the cleaner 30 is located below the photosensitive drum 10.

The process frame 50 is a frame that serves as a basis for the process unit 100. The process frame 50 rotatably holds the photosensitive drum 10 and is provided with the cleaner 30. The process frame 50 includes a cleaning blade attacher 33 and a waste toner receiver 35 that constitute the cleaner 30.

The charger cover 60 is a frame that is rotatably supported by the process frame 50. The charger cover 60 includes a charging unit holder 61, a rotator 63, a first position retainer 65, and a second position retainer 66.

The charging unit holder 61 is a member to which the charging unit 23 is detachably attached.

The rotator 63 is a member by which the charger cover 60 is rotatably supported on the process frame 50. The rotator 63 is provided in a location farther away from the photosensitive drum 10 than the charging roller 21 in a state where the charging roller 21 has been brought into contact with the photosensitive drum 10. For this reason, rotating the charger cover 60 on the rotator 63 makes it possible to move the charging roller 21 away from or closer to the photosensitive drum 10.

The first position retainer 65 and the second position retainer 66 are members that make contact with the horizontal plane HP in a case where a change in position has been made by rotating the charger cover 60 around the rotator 63.

The following describes changes in position of the charger cover 60 and the process frame 50 in the case of rotation of the charger cover 60 with respect to the process frame 50.

As shown in FIG. 3, in a state where the process unit 100 has been placed on the horizontal plane HP so as to be in such a position that the cleaner 30 is located below the photosensitive drum 10, the charger cover 60 assumes a first position P1 with the charging roller 21 brought into contact with the photosensitive drum 10. In a state where the charger cover 60 is in the first position P1, the height of the center of the rotator 63 above the horizontal plane HP is H1.

Further, in a state where the charger cover 60 has been placed in the first position P1, the process frame 50 assumes a fourth position P4. In a state where the process frame 50 has been placed in the fourth position P4 on the horizontal plane HP, the horizontal plane HP and the cleaning blade attacher 33 form a first angle D1.

Figure 4:
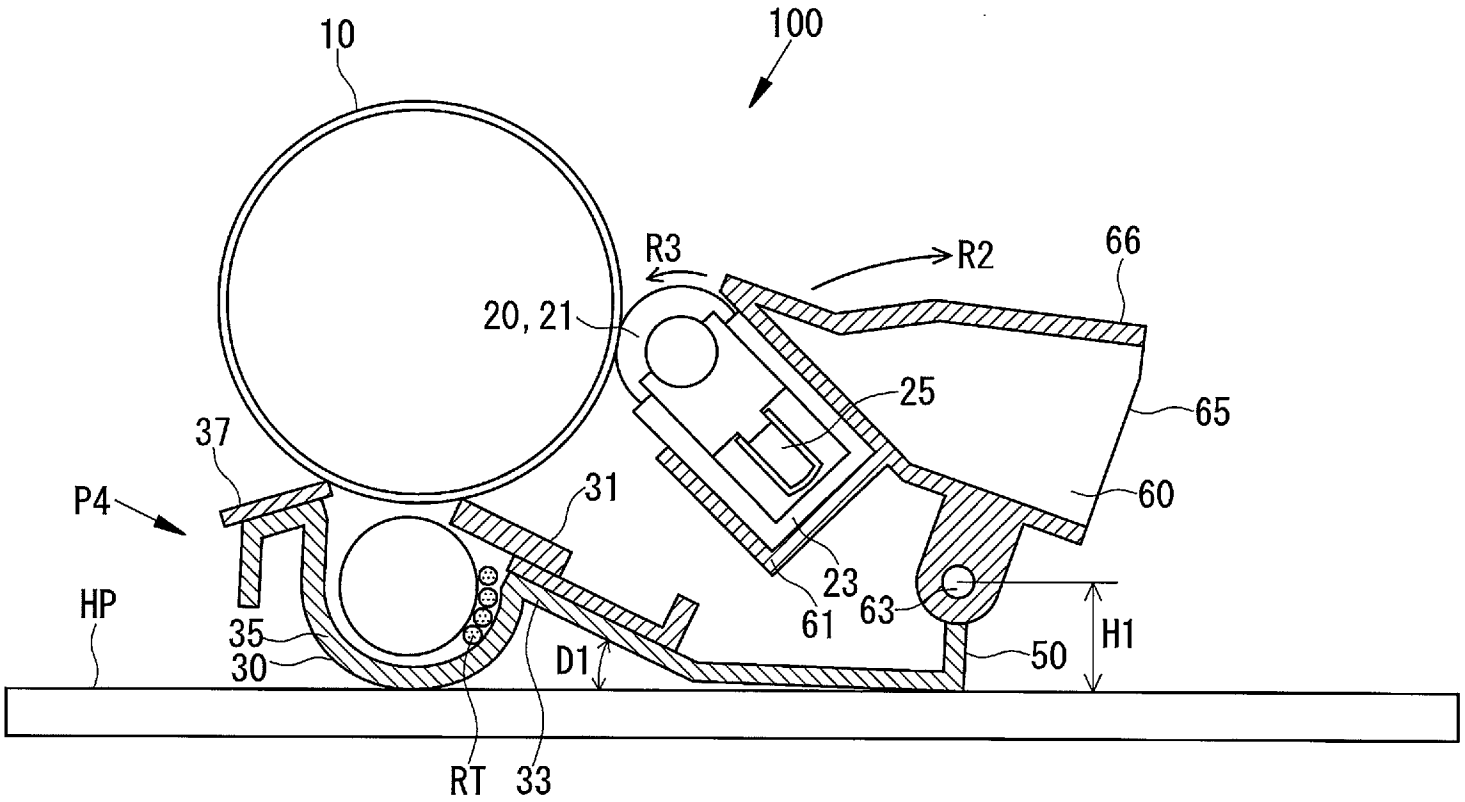
FIG. 4 is a cross-sectional view schematically showing a state where the process unit has been placed on the horizontal plane.

FIG. 4 shows a state where the charger cover 60 is rotated from the position shown in FIG. 3 in such a direction as to move the charging roller 21 away from the photosensitive drum 10 (i.e. in the direction of an arrow R2). Since the charging roller 21 is pressed against the photosensitive drum 10 by a biasing member 25, rotation of the charger cover 60 drives the charging roller 21 to rotate in the direction of an arrow R3 while in contact with the photosensitive drum 10. This makes it possible to move the charging roller 21 away from the photosensitive drum 10 without making a scratch or the like on the outer circumferential surface of the photosensitive drum 10. Meanwhile, the process frame 50 maintains the fourth position P4.

Figure 5:
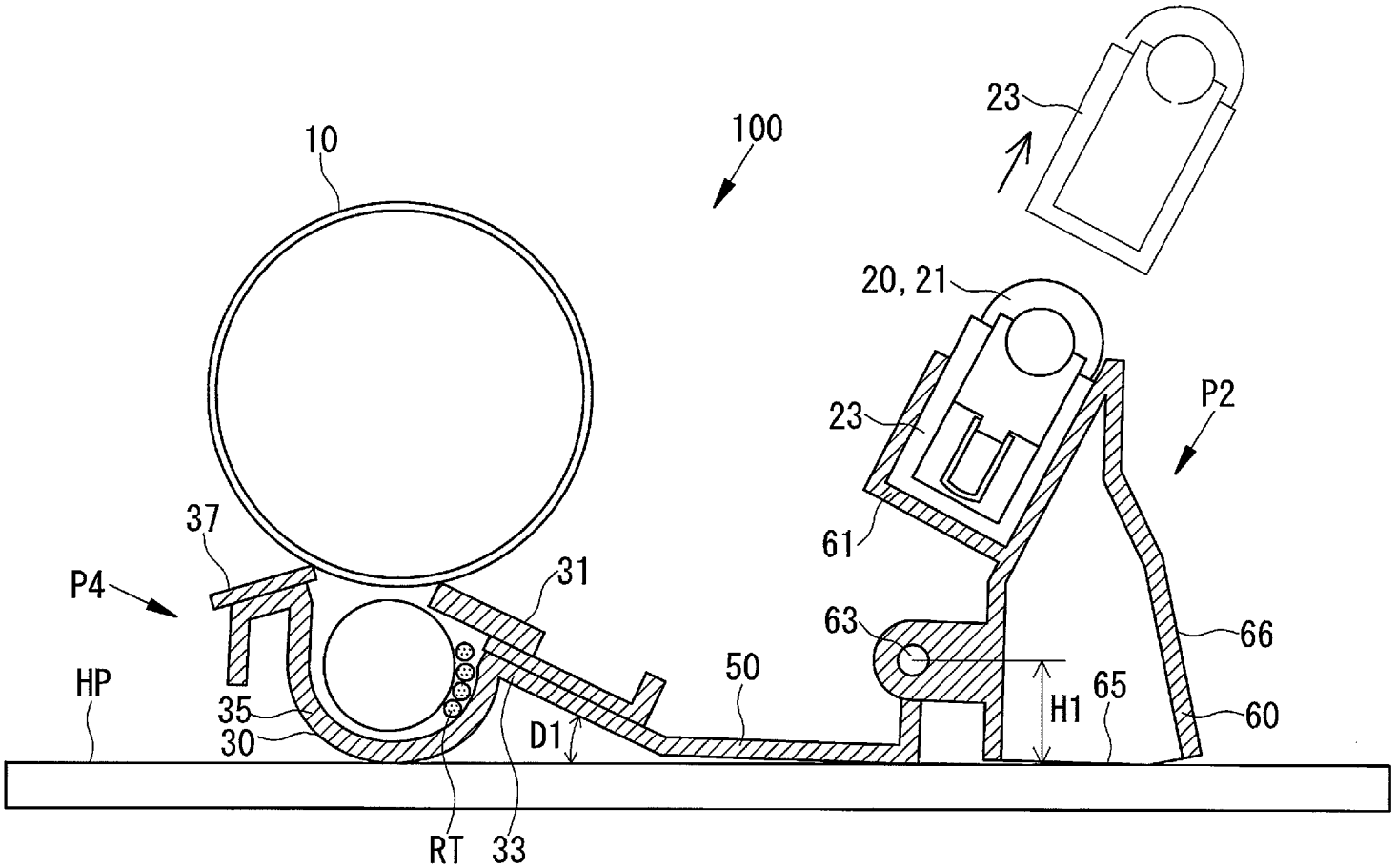
FIG. 5 is a cross-sectional view schematically showing a state where the process unit has been placed on the horizontal plane.

FIG. 5 shows a state where the charging roller 21 has been moved away from the photosensitive drum 10 and the charger 20 (charging unit 23) has been turned upward. As shown in FIG. 5, the charger cover 60 assumes a second position P2 with the first position retainer 65 in contact with the horizontal plane HP and the charger 20 (charging unit 23) turned upward.

Placing the charger cover 60 in the second position P2 by rotating it with respect to the process frame 50 makes it possible to move the charger 20 away from the photosensitive drum 10 and turn the charger 20 upward and therefore makes it possible to easily carry out maintenance of the charger 20, the photosensitive drum 10 and the cleaner 30. This makes it possible, for example, to replace the charger 20 (charging unit 23) with a new one or remove the photosensitive drum 10 without removing the charger 20 (charging unit 23). Further, starting powder can be applied to the photosensitive drum 10 with the photosensitive drum 10 kept held by the process frame 50. The starting powder is applied in order to improve slip between the photosensitive drum 10 and the cleaning blade 31. Since the charger 20 can be moved away from the photosensitive drum 10, defects in charging due to the adhesion of the starting powder to the charger 20 can be reduced.

Further, the second position P2 is stabilized by the first position retainer 65 being in contact with the horizontal plane HP. This makes it possible to keep the charger 20 away from the photosensitive drum 10 and therefore makes it possible to easily carry out maintenance of the charger 20, the photosensitive drum 10, and the cleaner 30.

In a state where the charger cover 60 is in the second position P2, the process frame 50 maintains the fourth position P4. For this reason, in a state where the charger cover 60 is in the second position P2, the height of the center of the rotator 63 above the horizontal plane HP is H1.

Figure 6:
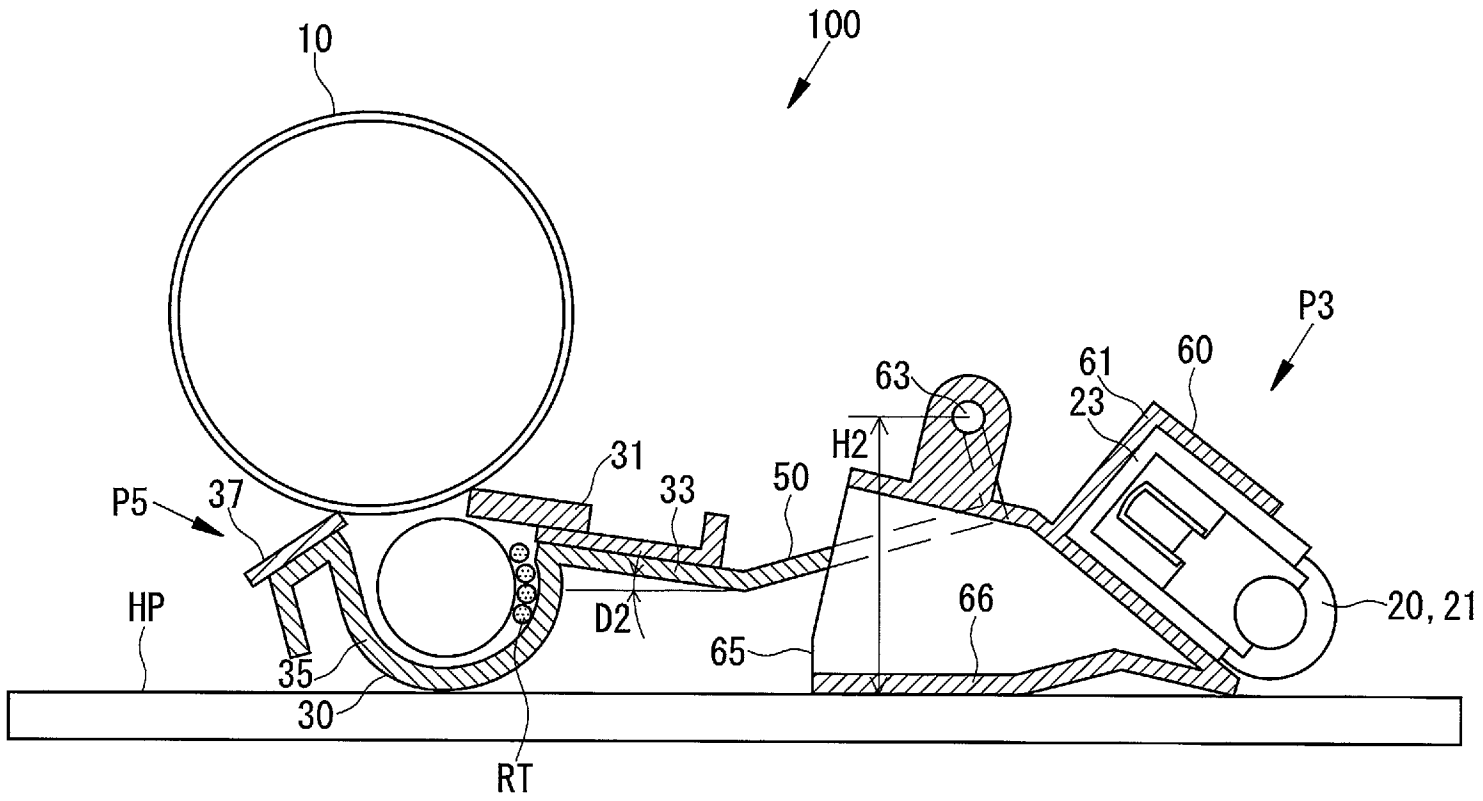
FIG. 6 is a cross-sectional view schematically showing a state where the process unit has been placed on the horizontal plane.

FIG. 6 shows a state where the charger cover 60 has been further rotated from the aforementioned second position P2. In FIG. 6, the second position retainer 66 is in contact with the horizontal plane HP, and a side of the process frame 50 that faces the rotator 63 is lifted by the charger cover 60. As shown in FIG. 6, in a state where the process unit 100 has been placed on the horizontal plane HP so as to be in such a position that the cleaner 30 is located below the photosensitive drum 10, the charger cover 60 assumes a third position P3 with the charger 20 moved away from the photosensitive drum 10 and the charger 20 turned in a direction opposite to the photosensitive drum 10. In a state where the charger cover 60 is in the third position P3, the height of the center of the rotator 63 above the horizontal plane HP is H2.

Further, in a state where the charger cover 60 has been placed in the third position P3, the process frame 50 assumes a fifth position P5. Assuming that the horizontal plane HP and the cleaning blade attacher 33 form a second angle D2 in a state where the process frame 50 has been placed in the fifth position P5 on the horizontal plane HP, the second angle D2 is smaller than the first angle D1. This is because a change in position of the process frame 50 from the fourth position P4 to the fifth position P5 as entailed by a change in position of the charger cover 60 from the first position P1 or the second position P2 to the third position P3 causes the height of the center of the rotator 63 above the horizontal plane HP to increase from H1 to H2. In other words, the shapes of the process frame 50 and the charger cover 60 (e.g. the shape of the second position retainer 66) are set so that the height of the center of the rotator 63 above the horizontal plane HP increases from H1 to H2 and the angle formed by the horizontal plane HP and the cleaning blade attacher 33 decreases from the first angle D1 to the second angle D2.

Figure 7:
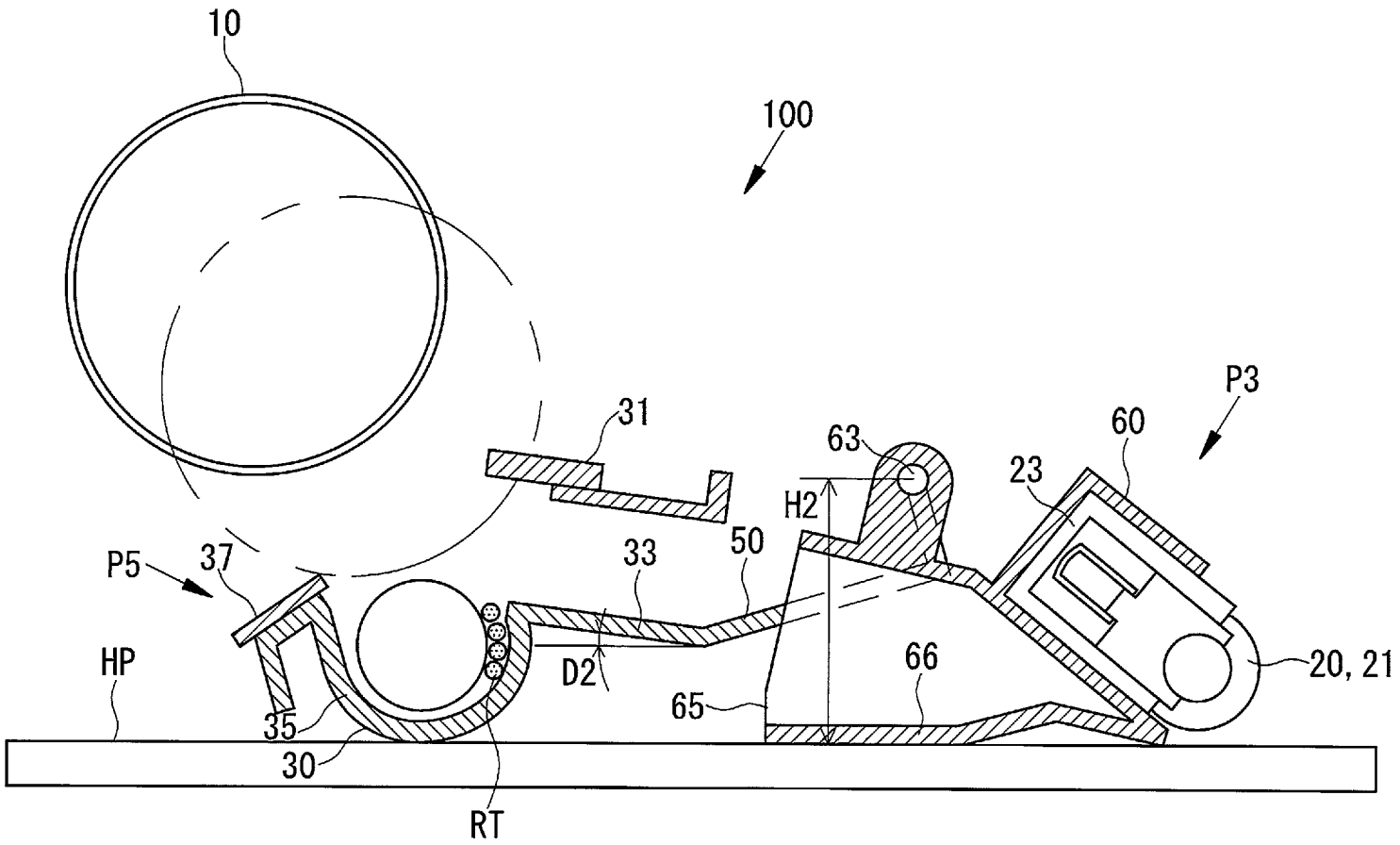
FIG. 7 is a cross-sectional view schematically showing a state where the process unit has been placed on the horizontal plane.

As shown in FIG. 7, the placement of the process frame 50 in the fifth position P5 and the decrease from the first angle D1 to the second angle D2 of the angle formed by the horizontal plane HP and the cleaning blade attacher 33 make it possible to inhibit waste toner RT from dropping from the waste toner receiver 35 into the process frame 50 in replacing the cleaning blade 31 with a new one. This makes it possible to improve maintainability of the cleaner 30.

Figure 8:
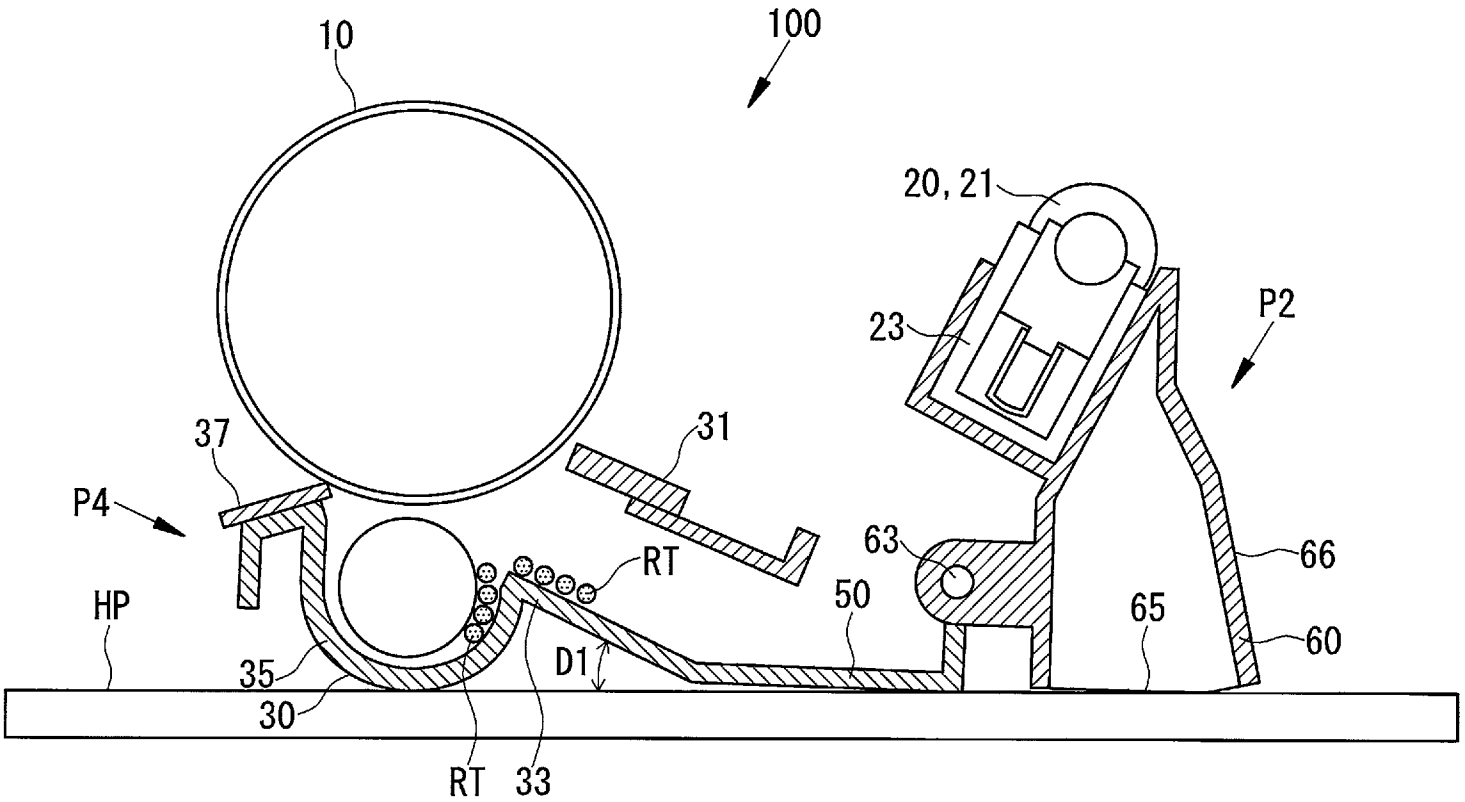
FIG. 8 is a cross-sectional view schematically showing a state where the process unit has been placed on the horizontal plane.
Figure 9:
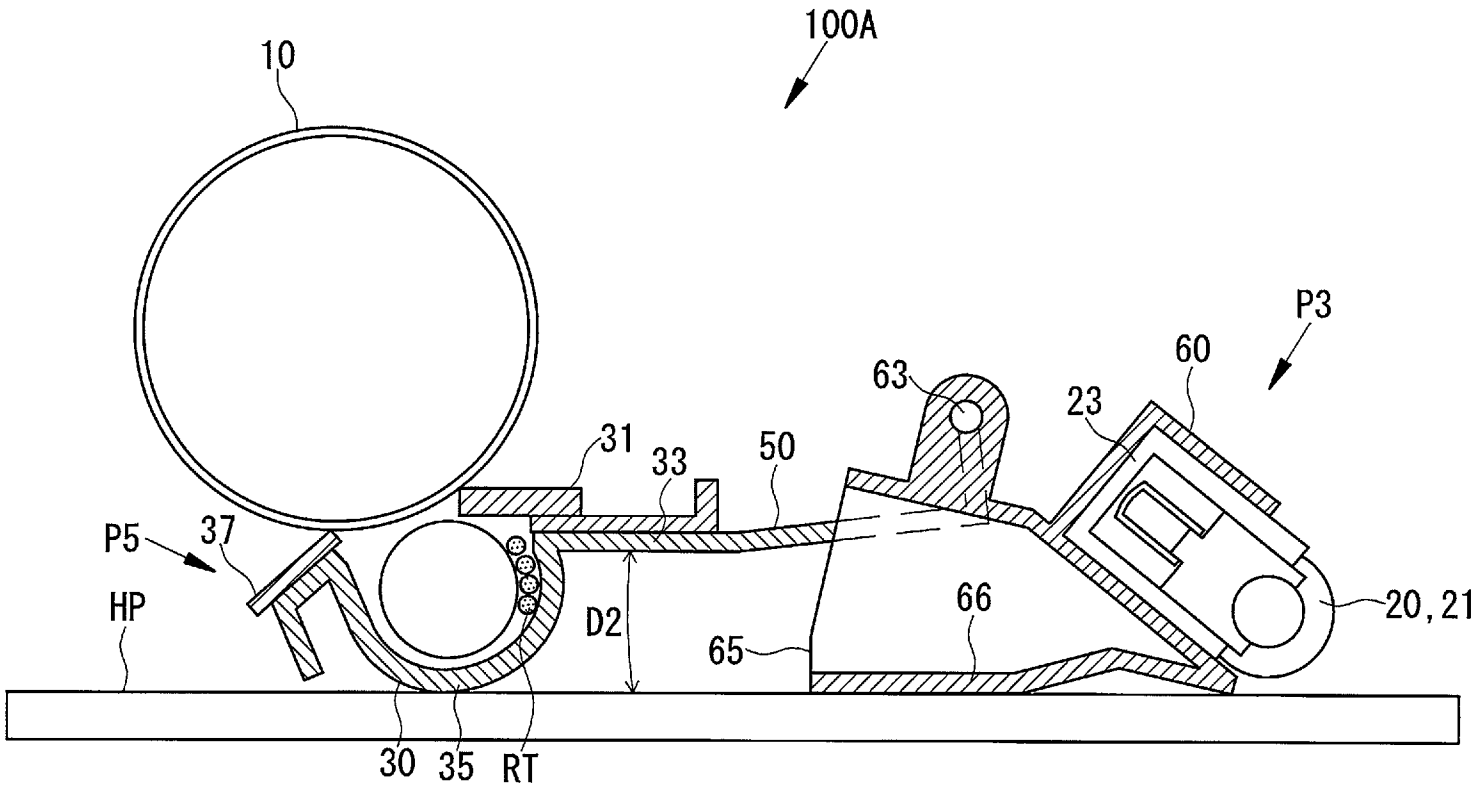
FIG. 9 is a cross-sectional view schematically showing a state where a process unit according to Embodiment 2 has been placed on a horizontal plane.

For comparison, FIG. 8 shows a state where the cleaning blade 31 has been removed from the cleaning blade attacher 33 in a state where the process frame 50 is in the fourth position P4. In FIG. 8, since the angle formed by the horizontal plane HP and the cleaning blade attacher 33 is the first angle D1, the waste toner RT easily flows over the waste toner receiver 35, with the result that the waste toner RT drops into the process frame 50. In Embodiment 1, as shown in FIG. 7, the placement of the process frame 50 in the fifth position P5 and the decrease from the first angle D1 to the second angle D2 of the angle formed by the horizontal plane HP and the cleaning blade attacher 33 make it possible to inhibit the waste toner RT from dropping into the process frame 50.

Embodiment 2

A process unit 100A according to Embodiment 2 of the present disclosure is configured such that in a state where the process frame 50 has been placed in the fifth position P5 on the horizontal plane HP, the second angle D2 formed by the horizontal plane HP and the cleaning blade attacher 33 is 0 degree. In this case, the waste toner RT can be inhibited from dropping from the waste toner receiver 35 into the process frame 50 in replacing the cleaning blade 31 with a new one. This makes it possible to improve maintainability of the cleaner 30.

In Embodiment 2, the cleaner 30 is provided with the toner-receiving sheet 37, which seals the space between the waste toner receiver 35 and the photosensitive drum 10. Since the waste toner RT hardly drops from the toner-receiving sheet 37, the toner-receiving sheet 37 may be lowered in a state where the process frame 50 is in the fifth position P5.

Embodiment 3

Figure 10:
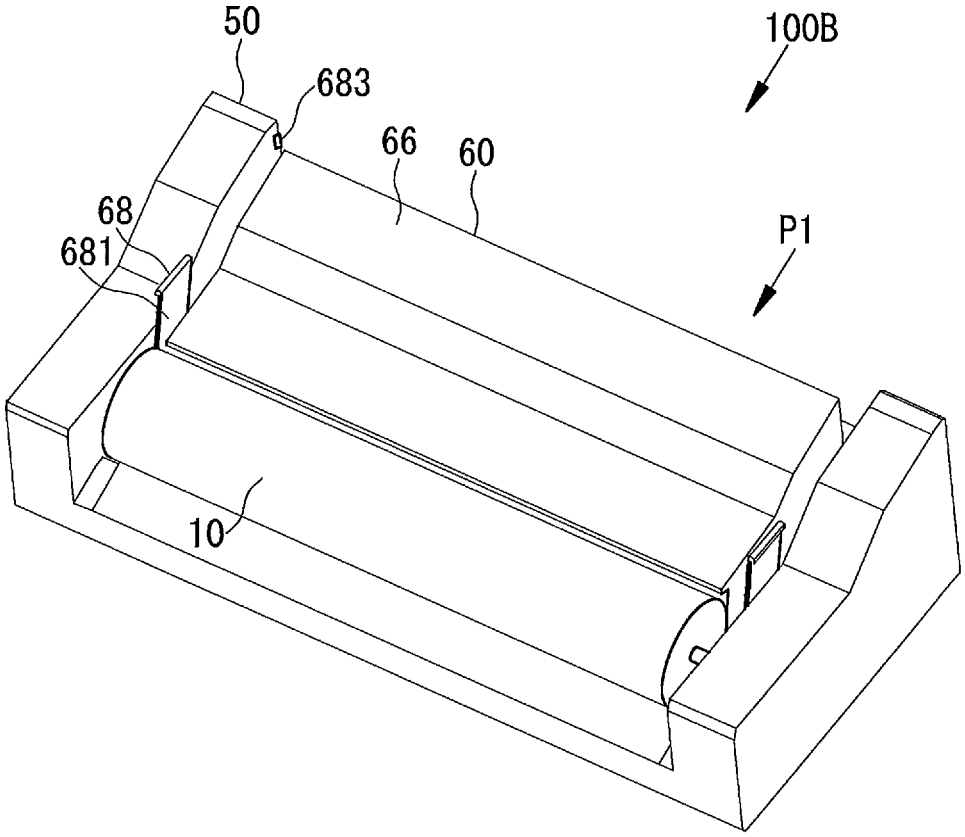
FIG. 10 is a perspective view showing a state where a process unit according to Embodiment 3 is in a first position.
Figure 11:
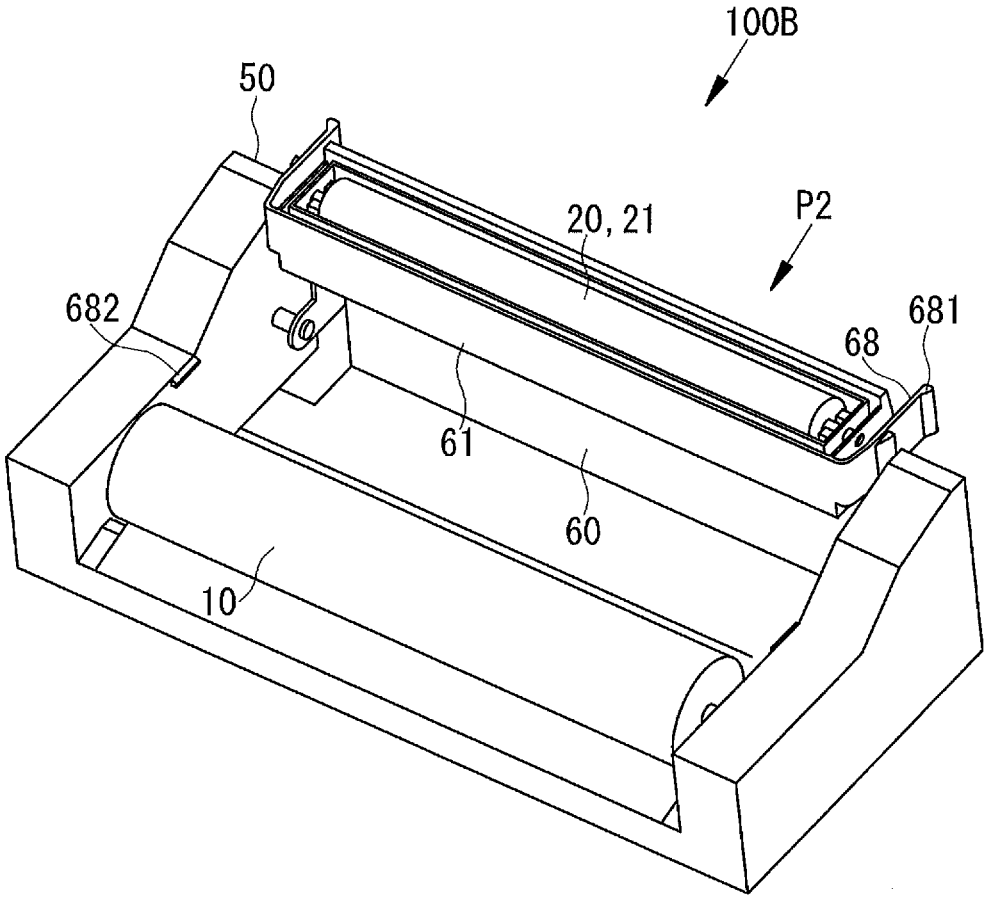
FIG. 11 is a perspective view showing a state where the process unit according to Embodiment 3 is in a second position.

A process unit 100B according to Embodiment 3 of the present disclosure is provided with a stopper 68 that allows the charger cover 60 to maintain its position. FIG. 10 is a perspective view showing a state where the process unit 100B according to Embodiment 3 is in the first position P1. FIG. 11 is a perspective view showing a state where the process unit 100B according to Embodiment 3 is in the second position P2.

As shown in FIGS. 10 and 11, the stopper 68 includes an arm 681 and locking lugs 682 and 683. As shown in FIG. 10, in a state where the charger cover 60 is in the first position P1, the arm 681 and the locking lug 682 become engaged so that the charger cover 60 is maintained in the first position P1. Further, as shown in FIG. 11, in a state where the charger cover 60 is in the second position P2, the arm 681 and the locking lug 683 become engaged so that the charger cover 60 is maintained in the second position P2.

In this case, the charger 20 can be kept away from the photosensitive drum 10 with the charger cover 60 maintained in the second position P2. This makes it possible to easily carry out maintenance of the charger 20, the photosensitive drum 10, and the cleaner 30.

Other Embodiments

The embodiments disclosed herein are examples in all respects and do not serve as the basis for limited interpretation. Accordingly, the technical scope of the present disclosure is not interpreted solely by the embodiments described above but is defined on the basis of the recitations in the scope of the claims. Further, all alterations falling within the meaning and range of equivalents of the scope of the claims are encompassed.

For example, although each of the present embodiments is configured such that the charger 20 constitutes the charging unit 23, the charging roller 21 may alternatively be attached to the charger cover 60.

The present disclosure is applicable to process units of electrophotographic image forming apparatuses and, in particular, to a process unit including a photosensitive drum, a charger, and a cleaner and an image forming apparatus including such a process unit.

The present disclosure contains subject matter related to that disclosed in Japanese Priority Patent Application JP 2018-079289 filed in the Japan Patent Office on Apr. 17, 2018, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A process unit comprising:

a photosensitive drum on which an electrostatic latent image is to be formed;

a charger that charges an outer circumferential surface of the photosensitive drum to a predetermined polarity and a predetermined potential;

a cleaner that removes residual toner from the outer circumferential surface of the photosensitive drum;

a process frame that holds the photosensitive drum and is provided with the cleaner; and a charger cover that is connected to the process frame via a rotating shaft and that holds the charger, the charger cover being supported on the process frame so as to rotate around the rotating shaft and to move the charger away from or closer to the photosensitive drum, wherein in a state where the process unit has been placed on a horizontal plane so as to be in such a position that the cleaner is located below the photosensitive drum, the charger cover is rotatable with respect to the process frame from a first position that the charger cover assumes in moving the charger closer to the photosensitive drum to a second position that the charger cover assumes in moving the charger away from the photosensitive drum and turning the charger upward, the cleaner includes a cleaning blade that scrapes the residual toner away from the photosensitive drum, a cleaning blade attacher, formed as part of the process frame, to which the cleaning blade is detachably fitted, and a waste toner receiver that accommodates residual toner scraped away by the cleaning blade, in a state where the process unit has been placed on the horizontal plane so as to be in such a position that the cleaner is located below the photosensitive drum, the charger cover is rotatable with respect to the process frame from the first position or the second position to a third position that the charger cover assumes in moving the charger away from the photosensitive drum and turning the charger in a direction opposite to the photosensitive drum, in a state where the charger cover has been placed in the first position, the process frame is placed in a fourth position on the horizontal plane, in a state where the charger cover has been placed in the third position, the process frame is placed in a fifth position on the horizontal plane, in a state where the process frame has been placed in the fourth position, the cleaning blade attacher forms a first angle with the horizontal plane, in a case where the process frame has been placed in the fifth position, the cleaning blade attacher forms a second angle with the horizontal plane, and the second angle is smaller than the first angle.

2. The process unit according to claim 1, wherein the second angle is substantially 0 degree.

3. The process unit according to claim 1, further comprising a stopper that maintains the charger cover in the second position.

4. The process unit according to claim 1, wherein the charger is provided in a charging unit, and the charging unit is attachable to and detachable from the charger cover.

5. The process unit according to claim 1, wherein the charger is a charging roller that charges the photosensitive drum by making contact with the outer circumferential surface of the photosensitive drum.

6. An image forming apparatus comprising the process unit according to claim 1.

* * * * *